US005653077A

United States Patent [19]

Carnicello et al.

[11] Patent Number: 5,653,077

[45] Date of Patent: Aug. 5, 1997

[54] ADJUSTABLE FLOOR JOIST SUPPORT SYSTEM

[75] Inventors: Robert A. Carnicello, Denver; Laurence M. Enomoto, Aurora; Daniel L. Delay, Lakewood, all of Colo.

[73] Assignee: Park Range Construction, Inc., Englewood, Colo.

[21] Appl. No.: 615,396

[22] Filed: Mar. 12, 1996

[51] Int. Cl.[6] ..... E04B 5/14

[52] U.S. Cl. ..... 52/646; 52/665; 52/338

[58] Field of Search ..... 52/650.3, 650.1, 52/664, 665, 668, 645, 646, 335–341, 348, 349, 450, 483.1

[56] References Cited

U.S. PATENT DOCUMENTS

| | | | |
|---|---|---|---|
| 2,974,762 | 3/1961 | Hunnebeck . | |
| 3,029,913 | 4/1962 | Liesenfeld . | |
| 3,062,340 | 11/1962 | Hunnebeck . | |
| 3,078,970 | 2/1963 | Black . | |
| 3,110,049 | 11/1963 | Nagin | 52/664 X |
| 3,310,922 | 3/1967 | Hoffmann | 52/664 X |
| 3,378,976 | 4/1968 | Meredith | 52/665 X |
| 3,818,083 | 6/1974 | Butts et al. | 52/334 |
| 3,889,779 | 6/1975 | Kümmerlin . | |
| 3,968,616 | 7/1976 | Gostling . | |
| 4,070,845 | 1/1978 | Cody . | |
| 4,151,694 | 5/1979 | Sriberg et al. | 52/338 |
| 4,640,077 | 2/1987 | Hall | 52/665 |
| 4,658,562 | 4/1987 | Brugman | 52/665 |
| 4,745,724 | 5/1988 | Reetz . | |
| 5,509,243 | 4/1996 | Bettigole et al. | 52/388 X |

*Primary Examiner*—Robert Canfield
*Attorney, Agent, or Firm*—John E. Reilly

[57] ABSTRACT

A floor joist support system for extension between foundation walls of the building structure employs a generally channel-shaped joist support member having slots arranged at spaced intervals and extending horizontally between a pair of foundation walls. A plurality of joist sections are arranged in oppositely directed pairs for extension between a second pair of foundation walls transversely of the joist support member, the joist pairs extending through adjacent pairs of slots in the joist support member. The joist sections are affixed both to the joist support member and the foundation walls after the total effective length of the joist pairs is adjusted to correspond to the distance between the second pair of foundation walls.

23 Claims, 2 Drawing Sheets

ADJUSTABLE FLOOR JOIST SUPPORT SYSTEM

BACKGROUND AND FIELD OF INVENTION

In accordance with the present invention, the present invention relates generally to joist systems used as structural supports when constructing floors or roofs; and more particularly, relates to a floor joist support system having adjustable joist sections to conform to distance between opposing foundation walls.

In the construction industry, typically, beams and girders are used to provide a structural framework when laying a concrete floor or assembling a roof. Generally, when a basement or ground floor is built, a platform or deck is then secured to the beam framework and the concrete poured over the top of the platform or deck. Once the concrete has set, the girders or joists are typically removed from beneath the new concrete floor, a process which, if not done carefully, can crack or otherwise disturb the new floor. See, for example, Hunnebeck's U.S. Pat. Nos. 2,974,762 and 3,062,340.

Hunnebeck's devices also attempted to provide a means of adjusting girders to vary the length according to the desired span between foundation walls by providing telescoping girder units. Similarly, U.S. Pat. No. 3,078,970 to Black; U.S. Pat. No. 3,029,913 to Liesenfeld; U.S. Pat. No. 4,070,845 to Cody; and U.S. Pat. No. 3,968,616 to Gostling have attempted to provide adjustable trusses or beams for use in concrete scaffolding or as support forms for concrete roofs, decks and roadways, and in combination with decking. While the prior art has contemplated the use of telescoping or otherwise adjustable beams and trusses in floor construction, none discloses a way of utilizing adjustable length beam members as a part of the floor structure with ends of the beams permanently affixed to the foundation wall structures.

Furthermore, the present invention provides a distinct advantage over the above cited prior art devices by not only providing a floor system that may remain as a permanent ground floor in a structure, but in providing a system that employs a joist support member as a floor support beam that can accommodate either telescoping joists or pairs of joists in overlapping relation to one another within a joist support. Because the beam ends are permanently affixed to the foundation walls and also to the joist support itself after the total length of the telescoping joist or cooperating joist pairs is adjusted, the system of the present invention is especially useful in areas where the ground tends to heave or shift, or cannot otherwise be graded to support a ground floor constructed directly thereon. Thus, the present invention provides a suspended floor system suited to these types of environments, and also allows for adjustability of the joists through a joist support to accommodate possible discrepancies between plan measurements and the distances actually encountered during the construction process.

SUMMARY OF THE INVENTION

It is therefore and object of the present invention to provide a floor joist support system that may serve as a permanent, suspended ground floor in a residence or other structure when the supporting ground surface cannot accommodate a floor constructed directly thereon.

It is a further object of the present invention to provide a floor joist support system which employs joists that can be adjusted for extension between foundation walls of a building, thus accommodating variances in building plans and actual distances.

It is yet a further object of the present invention to provide a floor joist support system that includes a joist support member that will serve as a floor support beam and that will allow adjustment of joists or beams when the beams are either in telescoping or overlapping relation to one another within the joist support.

Still a further object of the present invention is to provide a floor joist support system in which the adjustable beams are permanently secured to both the foundation walls and to the joist support member thereby providing a stable base for attachment of a floor deck which will fully occupy the space between the foundation walls.

In accordance with the present invention, a floor joist support system for extension between foundation walls of a building structure employs a joist support member on a foundation support, the joist support member having slots arranged in adjacent pairs at spaced intervals along the joist support member. The foundation support member supports the joist support member at a level required to support a floor, with the joist support member extending horizontally between a first pair of foundation walls. A plurality of joist sections are arranged in oppositely directed pairs for extension between a second pair of foundation walls transversely of the joist support member, the joist pairs extending through the adjacent pairs of slots in the joist support member. The joist sections are affixed both to the joist support member and the foundation walls after the total effective length of the joist pairs is adjusted to correspond to the distance between the second pair of foundation walls.

One or more joist support members may be utilized, or a single channel-shaped joist support is contemplated, wherein each sidewall of the channel has adjacent pairs of slots aligned for insertion of overlapping or telescoping ends of the joist section pairs. There may be one or more joist support members and foundation support members depending upon the size of the floor. The floor joist support system as described above is intended to support a standard floor deck which will fully occupy the space between the foundation walls. Once the floor deck is secured to the joist section and joist support member assembly, concrete may be poured over the floor deck. If a channel-shaped joist support member is employed, the channel is filled with the concrete thereby permanently securing the overlapping ends of the joist section within the center of the channel as well as providing a floor support beam.

The above and other objects of the present invention will become more readily appreciated and understood from a consideration of the following detailed description of the preferred and modified forms of the present invention when taken together with the accompanying drawings in which:

DETAILED DESCRIPTION OF THE PREFERRED EMBODIMENT

Figure 1:
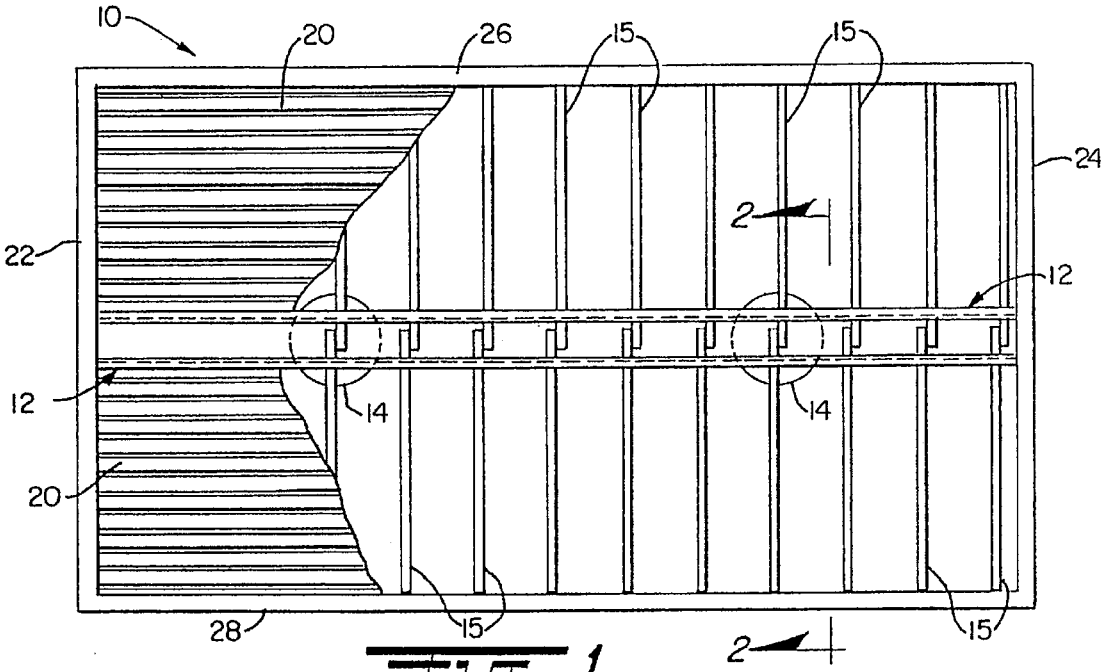
FIG. 1 is a top view of the floor joist support system of the present invention, with a cutaway of the floor deck, showing overlapping joist section ends within a channel-shaped joist support member.
Figure 2:
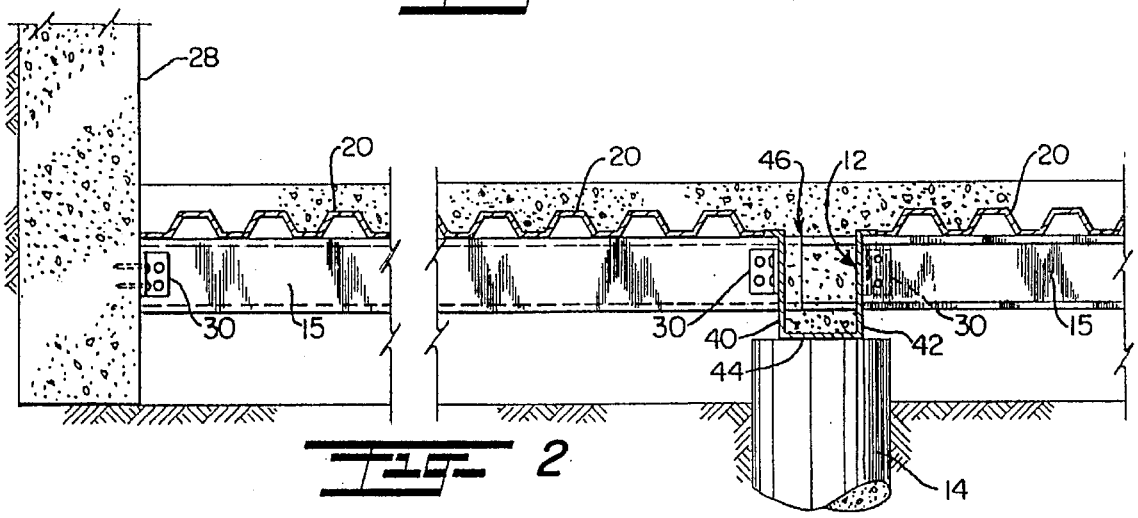
FIG. 2 is a cross-sectional view, taken along lines 2—2 of FIG. 1, illustrating the joist support member upon a foundation support member, and the floor deck mounted to the joist support member and joist section assembly.

Referring now to the drawings in detail and in particular to FIGS. 1 and 2, an adjustable floor joist support system 10 for extension between foundation walls of a building structure broadly comprises a metal joist support member 12 on at least one foundation support 14 and a plurality of metal joist sections 15. The joist support member 12 includes a plurality of slots 16 arranged in adjacent pairs at spaced intervals along the joist support member 12, which will be described in more detail below with reference to FIGS. 4 through 6.

As FIGS. 1 and 2 illustrate, the joist support member 12 is supported by the foundation support 14 at a level and height from a ground surface 18 which can support a floor 20. The joist support member 12 extends horizontally between a first pair of foundation walls 22, 24 and is secured at each end to the walls 22, 24, preferably with a right-angled clip 30 bolted through each of the joist support member 12 and wall 22, 24. The clip member 30 will be described and discussed in more detail with reference to FIGS. 5 and 6.

The joist sections 15 are preferably steel and arranged in oppositely directed pairs for extension between a second pair of foundation walls 26, 28 transversely of the joist support member 12, with the joist section pairs extending through adjacent pairs of slots 16. After the total effective length of the joist section pairs 15 is adjusted to correspond to the distance between the second pair of foundation walls 26, 28, each joist section 15 as secured to the joist support member 12 and to a foundation wall 26, 28 in a similar manner described above, that is, using a right-angled clip 30.

Once the joist support member 12 is secured at each end to the foundation wall 22, 24, and each joist section 15 is secured both to a foundation wall 26, 28, as well as to the joist support member 15, a standard steel floor deck 20 may be mounted on and secured to the joist section and joist support member assembly so that the deck 20 fully occupies the space between the foundation walls 22, 24, 26, 28. Finally, concrete 32 is evenly distributed in a layer across the floor deck 20. As FIG. 2 indicates, the floor deck 20 may include a number of slots or holes therethrough above each joist support member 12, so that when the concrete 32 is poured across the floor deck 20, a portion of the concrete 32 will be dispensed into the joist support member 12 and around the joist sections 15 retained therein. In this manner, the joist sections 15 are firmly secured within the joist support member 12 which also function as a solid support beam running transversely beneath the newly constructed floor.

Figure 3:
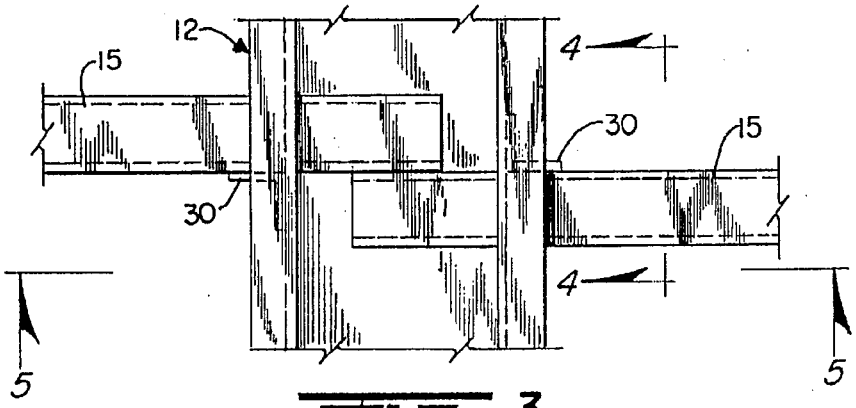
FIG. 3 is a top, detail view of the floor joist sections in overlapping relation to one another within the floor joist support member.

As noted above, and as shown in FIGS. 2, 5 and 6, the joist support member 12 may be channel-shaped, having a pair of substantially parallel sidewalls 40, 42, a closed lower end 44, an open upper end 46. When in this configuration, the slots 16 are disposed in the pair of sidewalls 40, 42 so that the joist sections 15 may be adjusted through the slots 16 until the desired total length is established between the foundation walls 26, 28. As shown in FIGS. 1, 3 and 6, the joist sections 15 may lie in overlapping relation to one another within the joist support member 15, or more specifically, between the pair of sidewalls 40, 42, if the joist support member 12 is channel-shaped. The present invention also contemplates that the joist sections 15 are disposed in telescoping relation to one another within the joist support member 12; that is, an end of a joist section 15 may be slidably inserted into an adjacent end of a second joist section 15 and the combined length between the foundation walls 26, 28 thereby adjusted.

Figure 4:
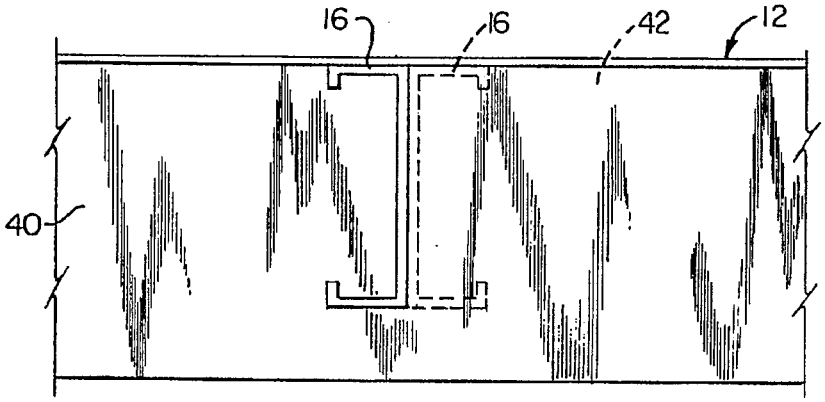
FIG. 4 is a cross-sectional view taken along lines 4—4 of FIG. 3 illustrating C-shaped slots in the joist support member.

As noted above, the joist support member 12 includes a plurality of slots 16 arranged in adjacent pairs at spaced intervals along the length of the joist support member 12. The present invention contemplates the use of generally C-shaped slots arranged in mirror-imaged pairs through opposite sides of the joist support member 12. If the joist support member 12 is a channel, a pair of the C-shaped slots 16 are disposed in a channel sidewall 40, 42. This configuration accommodates the free end of a C-joist inserted therein. While the present invention, as shown in FIG. 4, discloses C-shaped slots and joists, other shaped slots and joists may also be employed to the same effect.

Figure 5:
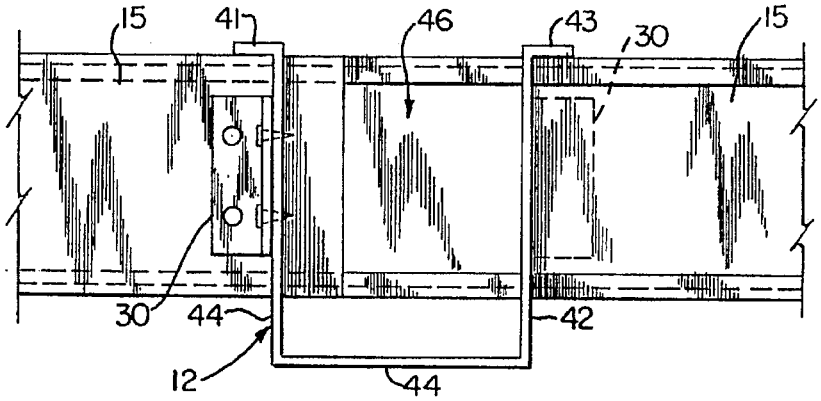
FIG. 5 is a cross-sectional view taken along lines 5—5 of FIG. 3 illustrating the attachment means for securing the joist sections to the joist support member.
Figure 6:
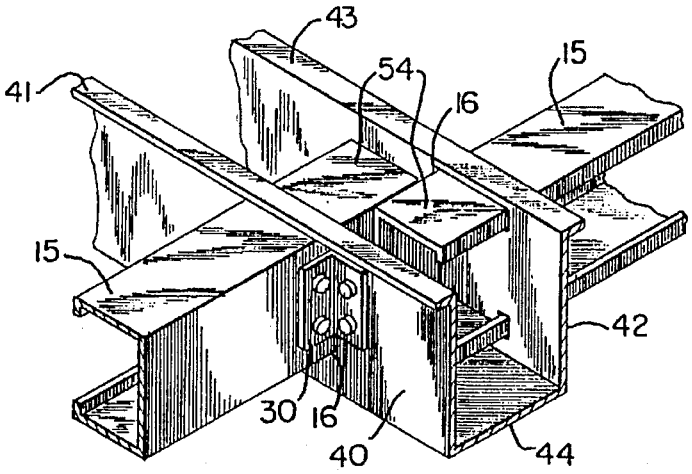
FIG. 6 is perspective view of a channel-shaped joist support member with the joist section ends lying in overlapping relation to one another within the channel.

FIGS. 5 and 6 illustrate the means for attachment and securement of the joist sections 15 to the joist support member 12. As noted above, the attachment means is preferably a right-angled metal corner clip 30 bolted through the joist section 15 and the joist support member 12 at their intersection point. As illustrated in FIG. 2, a right-angled metal clip also may be employed to secure the opposite end 50 of the joist section to a foundation wall 26, 28. As shown in FIGS. 3 and 5, the present invention contemplates the use of a pair of right-angled clips 30 each of which is secured to one in a pair of telescoping or overlapping joist sections 15 at opposite sides of the joist support member 12. In this manner, the joist sections 15 are firmly retained within the channel member 12 and thereby locked into the selected position, maintaining the total effective length achieved by the joist section pairs.

A preferred form of the present invention is shown in FIG. 6. As described above, the joist support member 12 may comprise a steel channel having opposite parallel sides 40, 42, a lower closed end 44 and an open upper end 46. The channel 50 may be elongated and extend between a pair of foundation walls 22, 24 and be secured thereto, as shown in FIGS. 1 and 2, or it is contemplated that shortened channel segments could be employed at overlapping or telescoping joist sections 15, and one or a plurality of such segments used, depending on the number of joist Section pairs utilized in the construction project. As FIG. 6 shows, free ends 54 of each joist section pair, shown in FIG. 6 as C-shaped, are received through pairs of C-shaped slots 16 within the sidewalls 22, 24. The free ends 54 are positioned between the sidewalls until each oppositely directed end reaches a suitable length for attachment to a foundation wall 26, 28. The present invention is intended to provide a six-inch expansion, or adjustment range, of the joist sections 15, but larger or smaller sized joist support members may be utilized to increase or decrease the expansion range. Once the total effective length of the joist pairs is adjusted to correspond to the distance between the second pair of foundation walls 26, 28, each joist section is anchored to an outside surface wall 22, 24, respectively, with attachment means, such as, screws or bolts, although the preferred attachment means is a right-angled clip 30 fastened in a corner created by the intersection of the joist section 15 and the joist member 12, as FIG. 6 shows.

It is therefore to be understood that while the preferred form of the invention is herein set forth and disclosed, various modifications and changes may be made therein without departing from the spirit and scope of the present invention as defined by the appended claims.

The above and other objects of the present invention will become more readily appreciated and understood from a consideration of the following detailed description of preferred and modified forms of the present invention when taken together with the accompanying drawings in which:

We claim:

1. A floor joist support system extending between foundation walls of a building structure; comprising:

a joist support channel having opposite longitudinal ends and substantially parallel sidewalls extending between a first pair of said foundation walls, each of said sidewalls having a plurality of slots therethrough, said slots arranged in complementary pairs in said sidewalls;

a foundation support member for supporting said joist support channel at a level required to support a floor;

a plurality of joist sections arranged in oppositely directed pairs extending between a second pair of said foundation walls transversely of said channel through said sidewalls, each said joist section having a free end received through one of said slots, said pairs disposed in overlapping relation to one another between said sidewalls to an extent necessary for said joist sections to traverse the distance between said second pair of said foundation walls;

first attachment means for securing said joist sections to said joist support channel and second attachment means for securing said joist sections to said second pair of said foundation walls; and a floor deck mounted on and secured to said joist sections and said joist support channel, said floor deck adapted to occupy the area between said foundation walls.

2. A floor system according to claim 1 wherein said joist support channel is generally U-shaped.

3. A floor system according to claim 2 wherein said first and second attachment means are right-angled clips.

4. A floor system according to claim 3 wherein said joist support channel and said joist sections are in perpendicular relation to one another.

5. A floor system according to claim 4 wherein said joist sections are generally C-shaped.

6. A floor system according to claim 5 wherein said slots are substantially C-shaped in configuration, said C-shaped slots adapted to receive C-shaped free ends of said joist sections.

7. A floor system according to claim 6 wherein each said joist section is secured to one of said foundation walls.

8. A floor system according to claim 7 wherein said joist support channel extends approximately under the middle of said floor-deck.

9. A floor system according to claim 8 wherein said joist support channel is secured to oppositely facing foundation walls by an attachment means.

10. A floor system according to claim 9 wherein said attachment means is a right-angled clip.

11. A floor system according to claim 10 including a layer of concrete disposed over said floor deck and in said joist support channel.

12. A floor system according to claim 11 wherein said floor deck includes a plurality of openings therethrough.

13. A floor joist support system extending between foundation walls of a building structure, comprising:

at least one joist support member extending between a first pair of said foundation walls, said joist support member having slots arranged at spaced intervals along said joist support member;

at least one foundation support member for supporting said joist support member at a level required to support a floor;

a plurality of joist sections arranged in oppositely directly pairs for extension between a second pair of said foundation walls transversely of said joist support member, said pairs adjustably extending through said slots and secured to said joist support member when a total effective length of said pairs is adjusted to correspond to a distance between said second pair of said foundation walls; and a floor deck mounted on and secured to either of said joist sections or said joist support member.

14. A floor system according to claim 13 including first attachment means for securing said joist sections in fixed relation to said joist support member.

15. A floor system according to claim 14 including second attachment means for securing said joist sections in fixed relation to said second pair of said foundation walls.

16. A floor system according to claim 15 wherein said first and second attachment means are right-angled clips.

17. A floor system according to claim 16 wherein each said joist section has a free end received through one of said slots, said pairs disposed in overlapping relation to one another to an extent necessary for said joist sections to traverse the distance between said second pair of foundation walls.

18. A floor system according to claim 13 wherein said joist support member comprises a channel having substantially parallel sidewalls, a closed lower end, and an open upper end.

19. A floor system according to claim 18 wherein each said sidewall has adjacent pairs of said slots aligned for insertion of said joist section pairs.

20. A floor system according to claim 19 wherein said floor deck fully occupies space between said foundation walls.

21. A floor system according to claim 20 wherein said floor deck includes at least one opening therethrough.

22. A floor system according to claim 21 including a layer of concrete disposed evenly upon said floor deck and into said joist support member.

23. A floor system according to claim 22 wherein said slots and said joist sections are C-shaped.

* * * * *